US011465873B2

(12) United States Patent
Tanoue et al.

(10) Patent No.: US 11,465,873 B2
(45) Date of Patent: Oct. 11, 2022

(54) POST-PROCESSING APPARATUS AND IMAGE FORMING SYSTEM

(71) Applicant: Ricoh Company, Ltd., Tokyo (JP)

(72) Inventors: Shinji Tanoue, Kanagawa (JP); Katsuji Yamaguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/316,917

(22) Filed: May 11, 2021

(65) Prior Publication Data

US 2021/0354947 A1 Nov. 18, 2021

(30) Foreign Application Priority Data

May 18, 2020 (JP) ..... JP2020-086481

(51) Int. Cl.
*B65H 37/04* (2006.01)

(52) U.S. Cl.
CPC ..... *B65H 37/04* (2013.01)

(58) Field of Classification Search
CPC combination set(s) only.
See application file for complete search history.

(56) References Cited

U.S. PATENT DOCUMENTS

2010/0237556 A1 9/2010 Azuma et al.
2011/0074081 A1 3/2011 Hirabayashi et al.
2015/0183610 A1* 7/2015 Matsuki ..... B65H 31/04 270/58.08
2016/0159605 A1* 6/2016 Miyahara ..... B65H 37/04 270/1.01
2016/0340145 A1 11/2016 Kunieda et al.
2018/0272784 A1* 9/2018 Awano ..... B65H 37/04
2020/0172367 A1 6/2020 Tanoue et al.

FOREIGN PATENT DOCUMENTS

JP 2018-199576 12/2018
JP 2019-167182 10/2019

* cited by examiner

*Primary Examiner* — Jennifer Bahls
(74) *Attorney, Agent, or Firm* — Xsensus LLP

(57) ABSTRACT

A post-processing apparatus includes a loading portion, a first binder, a first mover, a second binder, a second mover, and circuitry. A plurality of sheets are placed as a sheet bundle on the loading portion. The circuitry executes a control mode in which, before the sheet bundle as a target to be bound by one binder of the first binder and the second binder is placed on the loading portion and after the one binder starts moving from a corresponding reference position of a first reference position and a second reference position, the circuitry causes the other binder of the first binder and the second binder to perform binding instead of the one binder. The circuitry executes the control mode, without returning the one binder to the corresponding reference position, in a state in which the one binder and the other binder do not contact each other.

10 Claims, 8 Drawing Sheets

POST-PROCESSING APPARATUS AND IMAGE FORMING SYSTEM

CROSS-REFERENCE TO RELATED APPLICATION

This patent application is based on and claims priority pursuant to 35 U.S.C. § 119(a) to Japanese Patent Application No. 2020-086481, filed on May 18, 2020, in the Japan Patent Office, the entire disclosure of which is hereby incorporated by reference herein.

BACKGROUND

Technical Field

Embodiments of the present disclosure relate to a post-processing apparatus to bind a sheet bundle as post-processing and an image forming system including an image forming apparatus, such as a copier, a printer, a facsimile machine, or a multi-functional apparatus including at least two functions of the copier, the printer, and the facsimile machine, and the post-processing apparatus.

Description of the Related Art

There is known a post-processing apparatus installed in an image forming apparatus, such as a copier or a printer, that includes a binding device that performs binding on a sheet bundle using metal staples and another binding device that performs binding on a sheet bundle without using metal staples.

Binding may be performed using the metal staples or without using the metal staples depending on a user's selection. At this time, when binding is performed by one of the two binding devices, binding is performed by moving one of the binding devices from a corresponding reference position to a desired binding position while keeping the other binding device waiting at the corresponding reference position so as not to hinder the binding.

SUMMARY

In an aspect of the present disclosure, a post-processing apparatus includes a loading portion, a first binder, a first mover, a second binder, a second mover, and circuitry. A plurality of sheets are placed as a sheet bundle on the loading portion. The first binder performs binding on the sheet bundle placed on the loading portion. The first mover moves the first binder from a first reference position to a desired binding position at which the first binder perform binding on the sheet bundle placed on the loading portion. The second binder performs binding on the sheet bundle placed on the loading portion. The second mover moves the second binder from a second reference position to a desired binding position at which the second binder performs binding on the sheet bundle placed on the loading portion. The circuitry executes a control mode in which, before the sheet bundle as a target to be bound by one binder of the first binder and the second binder is placed on the loading portion and after the one binder starts moving from a corresponding reference position of the first reference position and the second reference position, the circuitry causes the other binder of the first binder and the second binder to perform binding instead of the one binder. The circuitry executes the control mode, without returning the one binder to the corresponding reference position, in a state in which the one binder and the other binder do not contact each other.

In another aspect of the present disclosure, an image forming system includes an image forming apparatus and the post-processing apparatus. The image forming apparatus forms an image on a sheet. The post-processing apparatus performs post-processing on the sheet on which the image has been formed by the image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
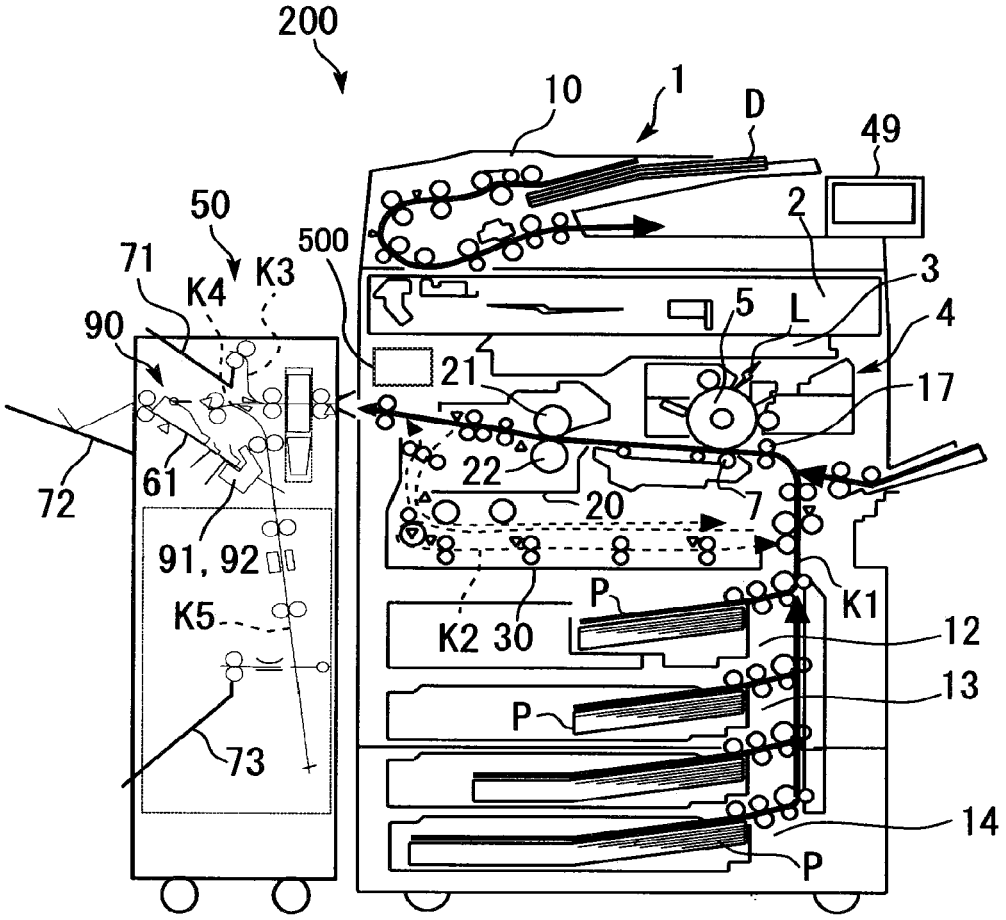
FIG. 1 is a diagram illustrating an overall configuration of an image forming system according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Next, a description is given of embodiments of the present disclosure, with reference to drawings. Note that identical reference numerals are assigned to identical components or equivalents and a description of those components is simplified or omitted.

First, the overall configuration and operation of an image forming system 200 is described with reference to FIG. 1.

In embodiments of the present disclosure, an image forming apparatus 1 includes a post-processing apparatus 50 detachably installed and connected with the image forming apparatus 1, and constitutes the image forming system 200 together with the post-processing apparatus 50.

In FIG. 1, the image forming apparatus 1 functioning as a copier includes a document reading device 2 that optically reads image information of a document D, and an exposure device 3 that irradiates a photoconductor drum 5 with exposure light L based on the image information read by the document reading device 2.

Further, the image forming apparatus 1 includes following components: an image forming device 4 that forms a toner image on the photoconductor drum 5, a transfer device 7 (image formation unit) that transfers the toner image formed on the photoconductor drum 5 onto a sheet P, and a document conveyance device 10 that conveys the document D placed on the document reading device 2.

The image forming apparatus 1 includes sheet feeding units 12, 13, and 14 in which sheets P such as sheets of paper are stored, and a registration roller pair 17 (timing roller pair) that conveys a sheet P toward the transfer device 7.

The image forming apparatus 1 includes a fixing device 20 to fix an unfixed image on the sheet P, a fixing roller 21 provided in the fixing device 20, and a pressure roller 22 provided in the fixing device 20.

The image forming apparatus 1 further includes: a double-sided conveyance device for reversing the sheet P having an image formed on the front side of the sheet P and conveying the sheet P toward the transfer device 7, an operation display panel 49 for displaying information relating to a printing operation (image forming operation) and a post-processing operation and for performing operations, A post-processing apparatus 50 performs post-processing on the sheet P ejected from the image forming apparatus 1 and conveyed into the post-processing apparatus 50. The post-processing apparatus 50 includes a loading portion 61 (internal tray) installed inside the post-processing apparatus 50, a first ejection tray 71, a second ejection tray 72, and a third ejection tray 73 (ejection trays) on which post-processed sheets P (or sheet bundle) are ejected and stacked, a binding device 90 installed inside the post-processing apparatus 50, and a first binder 91 and a second binder 92 in the binding device 90.

With reference to FIG. 1, a description is given of an operation of the image forming apparatus 1 (image forming system 200) in normal image formation (printing).

First, the document D is conveyed from a document table in a direction indicated by an arrow in FIG. 1 by conveyance rollers of the document conveyance device 10, and passes over the document reading device 2. At this time, the document reading device 2 optically reads image information of the document D passing above the document reading device 2.

The optical image information read by the document reading device 2 is converted into an electric signal and then transmitted to the exposure device 3 (writing device). The exposure light L such as laser light based on the image information of the electric signal is emitted from the exposure device 3 toward the photoconductor drum 5 of the image forming device 4.

On the other hand, in the image forming device 4, the photoconductor drum 5 rotates in a clockwise direction in FIG. 1, and an image (toner image) corresponding to the image information is formed on the photoconductor drum 5 through a predetermined image forming process (charging step, exposure step, and developing step).

Thereafter, the image formed on the photoconductor drum 5 is transferred onto the sheet P conveyed by the registration roller pair 17 in the transfer device 7 as an image formation unit.

On the other hand, the sheet P conveyed to the transfer device 7 (image formation unit) operates as follows.

First, one of the plurality of sheet feeding units 12, 13, and 14 of the image forming apparatus 1 is automatically or manually selected. For example, the uppermost sheet feeding unit 12 may be selected.

Then, an uppermost sheet P stored in the sheet feeding unit 12 is conveyed toward a conveyance path K1.

Thereafter, the sheet P passes through the conveyance path K1 in which a plurality of conveyance rollers are disposed, and reaches the position of the registration roller pair 17. The sheet P that has reached the position of the registration roller pair 17 is conveyed toward the transfer device 7 (image formation unit) at a timing matched with the image formed on the photoconductor drum 5 to align the sheet P with the image formed on the photoconductor drum 5.

After the transfer step, the sheet P passes through the position of the transfer device 7 and then reaches the fixing device 20 via the conveyance path K1. The sheet P having reached the fixing device 20 is fed between the fixing roller 21 and the pressure roller 22, and the image is fixed by heat received from the fixing roller 21 and pressure received from the fixing roller 21 and the pressure roller 22. The sheet P on which the image has been fixed is sent out from a nip between the fixing roller 21 and the pressure roller 22, and then ejected from the image forming apparatus 1.

When a "double-sided printing mode" in which printing is performed on both sides (a front side and a back side) of the sheet P is selected, the sheet P having undergone the fixing step on the front side is guided to a double-sided conveyance path K2 instead of being directly ejected as in the case in which a single-side printing mode is selected. The sheet passes through double-sided conveyance path K2 and is conveyed again toward the transfer device 7 (image formation unit) after the conveyance direction of the sheet P is turned over by the double-sided conveyance device 30. An image is formed on the back side of the sheet P in the transfer device 7 by an image forming process similar to the image forming process described above. Thereafter, the sheet P passes through a fixing step in the fixing device 20 and passes through the double-sided conveyance path K2, and is ejected from the image forming apparatus 1.

In the present embodiment, the post-processing apparatus 50 is connected to the image forming apparatus 1, the sheet P ejected from the image forming apparatus 1 is conveyed to the post-processing apparatus 50, and post-processing is performed on the conveyed sheet P.

With reference to FIG. 1, the post-processing apparatus 50 according to the present embodiment conveys the sheet P conveyed from the image forming apparatus 1 to any one of three conveyance paths K3, K4, and K5 and performs different post-processing. The conveyance path K3 as a first conveyance path in the post-processing apparatus 50 is a conveyance path through which the sheet P conveyed from the image forming apparatus 1 is ejected to a first ejection tray 71 without going through post-processing. The conveyance path K4 as a second conveyance path in the post-processing apparatus 50 is a conveyance path for stacking the sheets P conveyed from the image forming apparatus 1 on the loading portion 61 (internal tray), performing binding on a rear end of the sheets P by one of two binders, the first binder 91 and the second binder 92 in the binding device 90 (first binding device), and ejecting the processed sheets P (sheet bundle PT) from an ejection port 50*b* toward a second ejection tray 72 (second ejection tray) by an ejection roller pair 55. The conveyance path K5 as a third conveyance path in the post-processing apparatus 50 is a conveyance path for temporarily conveying the sheet P conveyed from the image forming apparatus 1 to the second conveyance path K4, switching back the sheet P, then performing binding on a central portion of the sheet P by a binding device 83 (second binding device) and folding by a sheet folding blade 84 or the like, and placing the sheet P on the third ejection tray 73 (see FIG. 2).

The switching of the three conveyance paths K3, K4, and K5 described above is performed by a switching operation (rotation) of a bifurcating claw 81.

Figure 2:
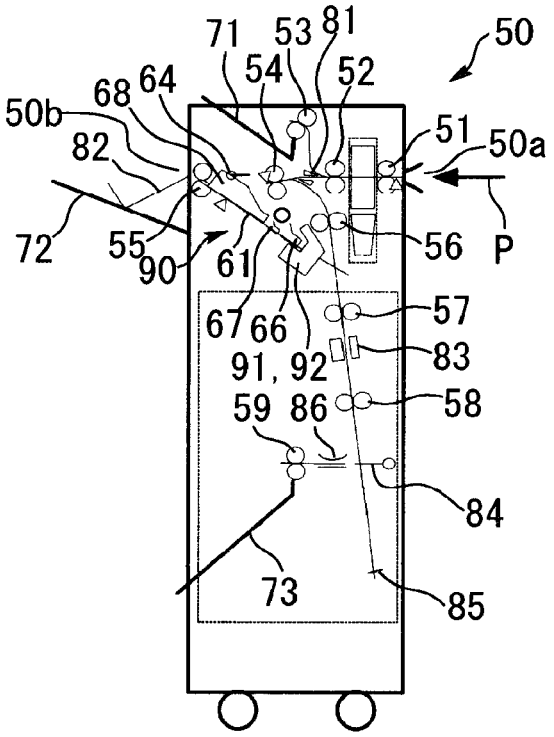
FIG. 2 is a diagram illustrating a post-processing apparatus of an image forming system according to an embodiment of the present disclosure.

More specifically, with reference to FIG. 2, a first conveyance roller 51 and a sheet detection sensor are provided near an entry port 50*a* of the post-processing apparatus 50, and the sheet P detected by the sheet detection sensor is conveyed into the post-processing apparatus 50 by the first conveyance roller 51 and a second conveyance roller 52. Then, based on an operation mode of the post-processing selected by the user in advance, the bifurcating claw 81 rotates so that the sheet P is guided to the desired one of the conveyance paths K3, K4, and K5.

When an operation mode in which post-processing is not performed is selected, the sheet P conveyed to the first conveyance path K3 is ejected by the third conveyance roller pair 53 and placed on the first ejection tray 71.

When a "sort mode (sorting mode)" is selected, the sheet P that has been conveyed to the second conveyance path K4 is conveyed sheet by sheet while being shifted by a predetermined amount in the width direction of the sheet P by the fourth conveyance roller 54. The fourth conveyance roller 54 is movable in the width direction of the sheet P (direction perpendicular to a plane on which FIG. 2 is drawn). Then, the sheet P is conveyed by the ejection roller pair 55 (fifth conveyance roller) to be sequentially stacked on the second ejection tray 72 (second ejection tray).

With reference to FIG. 2, a feeler 82 is provided above the second ejection tray 72 so as to be rotatable about a support shaft at an upper end of the feeler 82. The second ejection tray 72 is vertically movable by a moving mechanism. A state in which the central portion of the sheets P in the conveyance direction sequentially stacked on the second ejection tray 72 is in contact with the feeler 82 is detected by a sensor installed near the support shaft of the feeler 82. Thus, the height of the sheets P stacked on the second ejection tray 72 is detected. The vertical position of the second ejection tray 72 is adjusted in accordance with an increase or decrease in the number of sheets P stacked on the second ejection tray 72. When the vertical position of the second ejection tray 72 reaches a lower limit position, it is determined that the number of sheets P stacked on the second ejection tray 72 reaches an upper limit (a full state). Accordingly, a stop signal is transmitted from the post-processing apparatus 50 to the image forming apparatus 1 to stop the image forming operation.

When a "binding mode (stapling mode)" is selected, the sheet P conveyed to the second conveyance path K4 is conveyed by the fourth conveyance roller 54 without being shifted in the width direction of the sheet P as described above, and is sequentially stacked on the loading portion 61 (internal tray). Each time the sheet P (sheet bundle PT) is placed on a placement surface of the loading portion 61, a tapping roller 64 and an auxiliary conveyance roller 99 (see FIG. 3) disposed above the loading portion 61 move from standby positions to positions at which the tapping roller 64 and the auxiliary conveyance roller 99 contact an uppermost sheet P and the tapping roller 64 and the auxiliary conveyance roller 99 are driven to rotate counterclockwise in FIG. 2. Thus, the uppermost sheet P is conveyed (moved) toward a fence 66 (end fence). Such a configuration as described above allows the rear end (rear end in the conveyance direction) of the plurality of sheets P (sheet bundle PT) to abut against the fence 66. Thus, the positions of the plurality of sheets P in the conveyance direction are aligned.

Figure 3:
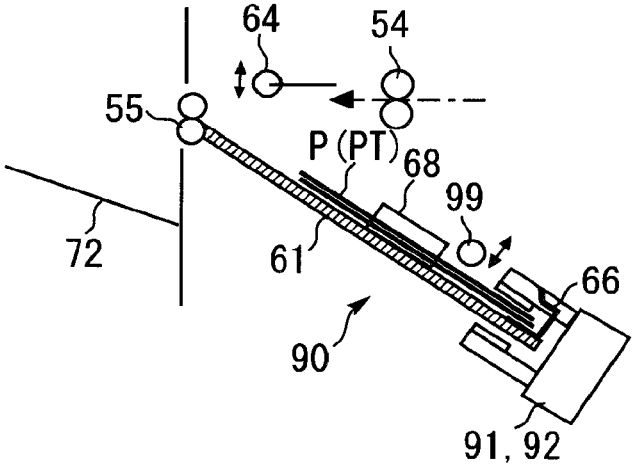
FIG. 3 is a diagram illustrating a binding device according to an embodiment of the present disclosure.

At this time, with reference to FIGS. 2, 3, and 4, each time the sheet P is placed on the loading portion 61 (or after a desired number of sheets P are placed on the loading portion 61), jogger fences 68 as side fences provided at both ends in the width direction of the loading portion 61 move in the width direction so as to sandwich the sheet P (sheet bundle PT). Thus, the positions of the sheets P (sheet bundle PT) in the width direction can be aligned. Then, the binding device 90 performs binding on the rear ends of the sheets P (sheet bundle) that have been aligned in the conveyance direction and the width direction of the sheets P.

Thereafter, the sheets P (sheet bundle PT) on which binding has been performed are moved obliquely upward along an inclination of the placement surface by the movement of an ejection claw 67 in the sheet ejection direction and is conveyed by the ejection roller pair 55 to be ejected onto the second ejection tray 72.

Note that the first binder 91 and the second binder 92 are installed in the binding device 90 according to the present embodiment and either the first binder 91 or the second binder 92 is selected to perform binding on the sheet bundle PT (sheet bundle), which will be described in detail later.

When a "folding mode" is selected, the sheet P is first conveyed to the second conveyance path K4. Thereafter, the fourth conveyance roller 54 reversely rotates to switch back the sheet P in a state in which the rear end of the sheet P is nipped by the fourth conveyance roller 54 to convey the sheet P to the third conveyance path K5. Then, the sheet P conveyed to the third conveyance path K5 is conveyed by a sixth conveyance roller 56, a seventh conveyance roller 57, and an eighth conveyance roller 58, to a position at which the central portion of the sheet P faces the binding device 83, which is a position at which a conveyance guide plate functions as a loading portion. After a desired number of sheets P (sheet bundle PT) are stacked at the above-described position, the binding device 83 performs binding on the center portion of the sheet bundle PT. Thereafter, the plurality of sheets P (sheet bundle PT) on which binding has been performed is conveyed by the seventh conveyance roller 57 and the eighth conveyance roller 58 to a position at which the central portion of the sheet P (sheet bundle PT) faces the sheet folding blade 84. At this time, the leading ends of the sheets P (sheet bundle PT) abut against a stopper 85. The stopper 85 is movable in the conveyance direction of the sheet P by a moving mechanism.

Then, the sheets P (sheet bundle PT) are folded by the sheet folding blade 84 moving leftward in FIG. 2 at the center portion of the sheet P and the folded portion of the sheets P is pressed by the sheet folding plate 86 to be folded. Thereafter, the sheets P (sheet bundle PT) that have been folded are conveyed by the ninth conveyance roller 59 and are placed on the third ejection tray 73.

Hereinafter, the configuration and operation of the post-processing apparatus 50 according to the present embodiment is described in detail.

As described above with reference to FIGS. 1 and 2, the post-processing apparatus 50 (the binding device 90) according to the present embodiment includes the loading portion 61 in which the plurality of sheets P are placed as the sheet bundle PT.

Specifically, the placement surface of the loading portion 61 is formed so as to be inclined upward from one end of the sheet P (the right side in FIGS. 2 and 3) toward the other end of the sheet P (the left side in FIGS. 2 and 3). The first binder 91 and the second binder 92 are provided below the inclined surface of the loading portion 61 away from the ejection port 50*b*.

The first binder 91 is moved from a first reference position (first home position) to a desired binding position by first mover (a first drive motor 113, a timing belt 114, and a first guide shaft 115) (see FIG. 6), and performs binding on the sheet bundle PT placed on the loading portion 61. In particular, in the present embodiment, the first binder 91 performs binding using staples (metal staples).

Specifically, the first binder 91 is moved from the first reference position (a position indicated by a solid line in FIG. 4) located at an end in the width direction (left side in FIG. 4) with respect to the sheet bundle PT stacked on the loading portion 61 to the other end in the width direction (right side in FIG. 4) by the first mover (the first drive motor 113, the timing belt 114, and the first guide shaft 115), and performs binding (binding using staples) on binding positions M1 and M2 on the sheet bundle PT.

Figure 4A:
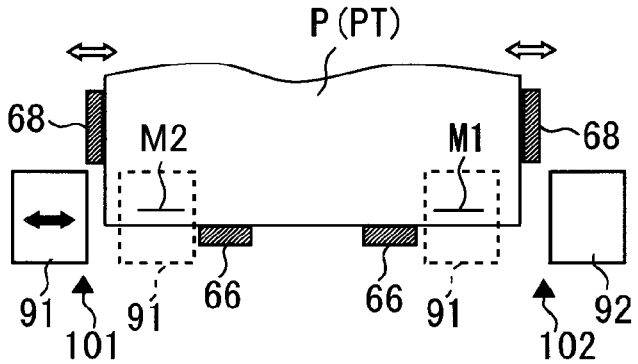
FIGS. 4A and 4B are top views of a main part of a binding device in a width direction of the binding device according to an embodiment of the present disclosure.

More specifically, FIG. 4A illustrates an example in which the first binder 91 performs binding at the two binding positions M1 and M2. With respect to the two binding positions M1 and M2, first, the first binder 91 is moved from the first reference position (the reference position located at further left side of the left end of the sheet bundle PT in FIG. 4) to the second binding position M2 (the position indicated by the broken line in FIG. 4A) located on the left side (one end side in the width direction), and binding at the second binding position M2 is performed. Thereafter, the first binder 91 is moved to the first binding position M1 (the position indicated by the broken line in FIG. 4A) located on the right side (the other end side in the width direction), and binding is performed at the first binding position M1. Thereafter, the first binder 91 is moved in the reverse direction and returned to the first reference position.

Note that, in the present embodiment, binding by the first binder 91 is performed at the two binding positions M1 and M2. However, the number of binding positions, binding positions, and binding order are not limited to the above example and binding can be performed in various forms.

Further, a known device can be used as the first binder 91 that performs binding using metal staples.

Figure 6:
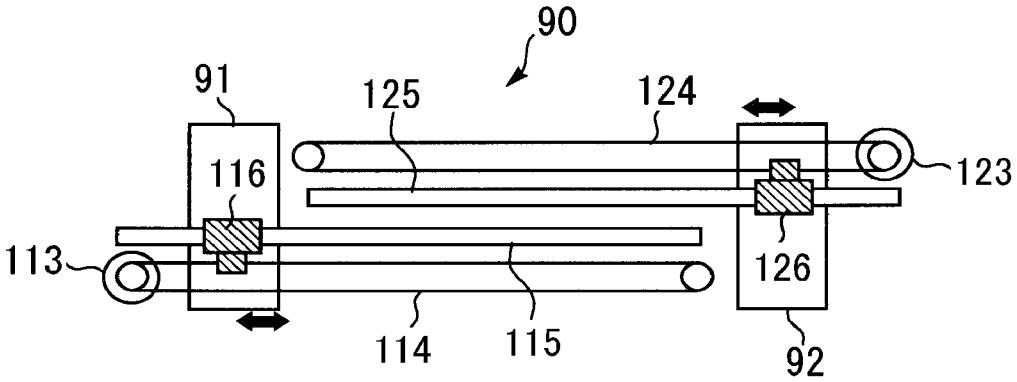
FIG. 6 is a schematic view of a drive mechanism of a binding device in a width direction of the drive mechanism according to an embodiment of the present disclosure.

With reference to FIG. 6, the first mover moves the first binder 91 along a first guide shaft 115 as a guide member.

Specifically, the first mover includes the first drive motor 113, the timing belt 114, and the first guide shaft 115, and the like. A bearing 116 is fixed to the first binder 91. The first binder 91 is slidably held by the first guide shaft 115 via the bearing 116. That is, the first guide shaft 115 extends from the first reference position toward the other end side in the width direction of the sheet P, and holds the first binder 91 movably in the width direction.

The bearing 116 of the first binder 91 is fixed at a predetermined position on the timing belt 114, and moves together with the first binder 91 as the timing belt 114 travels. The timing belt 114 is stretched and supported by two pulleys provided at both ends in the width direction. One of the two pulleys is installed on a motor shaft of the first drive motor 113 as a motor rotatable in forward and reverse directions.

Such a configuration allows the timing belt 114 to travel in the clockwise direction or the counterclockwise direction in FIG. 6 when the first drive motor 113 is driven under the control of a controller 500 serving as control circuitry. Thus, the first binder 91 moves in the direction indicated by black double arrow in a state in which the posture of the first binder 91 is maintained.

Note that, in the above-described binding operation of the first binder 91, the state in which the first binder 91 is positioned at the first reference position is detected by the position detection sensor 101, which is a photosensor, illustrated in FIG. 4A. Accordingly, the movement control of the first binder 91 is performed based on the detection result by the position detection sensor 101.

On the other hand, the second binder 92 is moved from a second reference position (second home position) to a desired binding position by a second mover (a second drive motor 123, a timing belt 124, and a second guide shaft 125) (see FIG. 6), and performs binding on the sheet bundle PT placed on the loading portion 61. In particular, in the present embodiment, the second binder 92 performs binding without staples (metal staples).

Specifically, the second binder 92 is moved from the second reference position (the position indicated by the solid line in FIG. 4) located on the other end side in the width direction with respect to the sheet bundle PT stacked on the loading portion 61 toward one end side in the width direction (the left side in FIG. 4) by the second mover (the second drive motor 123, the timing belt 124, and the second guide shaft 125), and performs binding (binding without staples) on the binding positions N1 and N2 of the sheet bundle PT.

Figure 5:
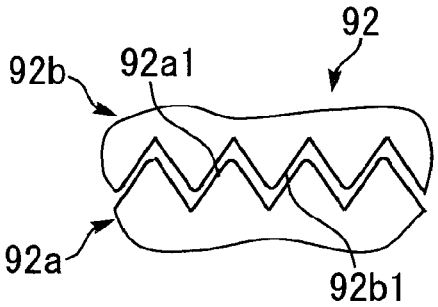
FIG. 5 is an enlarged view of convex-concave portions of a second binder of a binding device according to an embodiment of the present disclosure.

More specifically, with reference to FIG. 5, the second binder 92 presses a toothed convex-concave portion 92*a*1 and a toothed convex-concave portion 92*b*1 against the sheet bundle PT to form concave and convex portions on the sheet bundle PT in the direction of thickness of the sheet bundle PT, and meshes the sheets P with each other to perform binding. In the second binder 92, a first portion 92*a* and a second portion 92*b* are disposed in a substantially vertical direction. The toothed convex-concave portion 92*a*1 is formed on an upper surface of the first portion 92*a*. A lower surface of the second portion 92*b* is the toothed convex-concave portion 92*b*1 that meshes with the toothed convex-concave portion 92*a*1 of the first portion 92*a*. The second portion 92*b* is movable relative to the first portion 92*a* so as to sandwich the sheet bundle PT between the first portion 92*a* and the second portion 92*b*. The binding operation is performed in a state in which the sheet bundle PT is sandwiched between the first portion 92*a* and the second portion 92*b*.

Figure 4B:
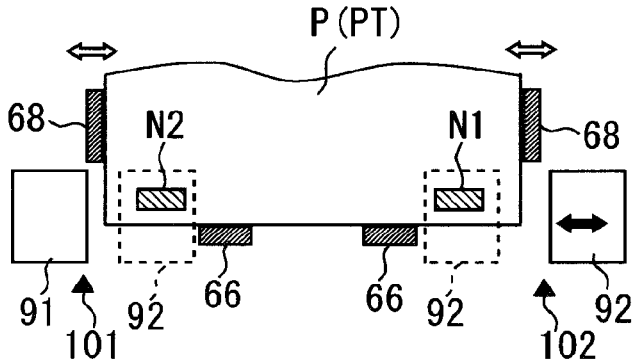

More specifically, FIG. 4B illustrates an example in which the second binder 92 performs binding at the two binding positions N1 and N2. With respect to the two binding positions N1 and N2, first, the second binder 92 is moved from the second reference position (the reference position located at further right side of the right end of the sheet bundle PT in FIG. 4) to the second binding position N2 (the position indicated by the broken line in FIG. 4B) located on the right side (one end side in the width direction), and binding at the first binding position N1 is performed. Thereafter, the second binder 92 is moved to the second binding position N2 (the position indicated by the broken line in FIG. 4A) located on the left side (the other end side in the width direction), and binding is performed at the second binding position N2. Thereafter, the second binder 92 is moved in the reverse direction and returned to the second reference position.

Note that, in the present embodiment, binding by the second binder 92 is performed at the two binding positions N1 and N2. However, the number of binding positions, binding positions, and binding order are not limited to the above example and binding can be performed in various forms.

With reference to FIG. 6, the second mover moves the second binder 92 along a second guide shaft 125 as a guide.

Specifically, the second mover includes the second drive motor 123, the timing belt 124, the second guide shaft 125, and the like. The bearing 126 is fixed to the second binder 92. The second binder 92 is slidably held by the second guide shaft 125 via the bearing 126. That is, the second guide shaft 125 extends from the second reference position toward one end side in the width direction of the sheet P, and holds the second binder 92 movably in the width direction.

The bearing 126 of the second binder 92 is fixed at a predetermined position on the timing belt 124, and moves together with the second binder 92 as the timing belt 124 travels. The timing belt 124 is stretched and supported by two pulleys provided at both ends in the width direction. One of the two pulleys is installed on a motor shaft of the second drive motor 123 as a motor rotatable in forward and reverse directions.

Such a configuration allows the timing belt 124 to travel in the clockwise direction or the counterclockwise direction in FIG. 6 when the second drive motor 123 is driven under the control of the controller 500 serving as control circuitry. Thus, the second binder 92 moves in the direction indicated by black double arrow in a state in which the posture of the second binder 92 is maintained.

Note that, in the above-described binding operation of the second binder 92, the state in which the second binder 92 is positioned at the second reference position is detected by a position detection sensor 102, which is a photosensor, illustrated in FIG. 4B. Accordingly, the movement control of the second binder 92 is performed based on the detection result by the position detection sensor 102.

In the post-processing apparatus 50 configured as described above, one binder out of the two binders, which are the first binder 91 or the second binder 92, is selected by the user, and a binding operation corresponding to the selection is performed.

Specifically, the user operates the operation display panel 49 (see FIG. 1) provided on the exterior of the image forming apparatus 1 to select one of the binding operations, "binding (with staples)" and "binding (without staples)". When the "binding (with staples)" operation is selected, binding by the first binder 91 is performed. When the "binding (without staples)" operation is selected, binding by the second binder 92 is performed. When binding is performed by the selected binder, the non-selected binder is in a state of being retracted to the corresponding reference position.

Providing the plurality of binders, such as the first binder 91 and the second binder 92 as described above allows to expand the range of binding options for the user.

In the post-processing apparatus 50 according to the present embodiment, "control mode" is performed in which before the sheet bundle PT as a target to be bound by either the first binder 91 or the second binder 92 is placed on the loading portion 61 and after the one binder starts moving from the corresponding one of the first reference position and the second reference position, the other binder (for example, the second binder 92) performs binding instead of the one binder. In this case, the one binder is not returned to the corresponding reference position.

The control mode includes, for example, an "interrupted print mode" and a "print reservation mode".

The "interrupted print mode" is a mode in which, based on a new print command issued during a preceding print operation, the preceding print operation is interrupted and another print operation is performed. When the user operates the operation display panel 49 to input conditions related to a desired print operation and selects the "interrupted print mode", even during the preceding print operation, the preceding print operation is interrupted and a subsequent print operation related to the "interrupted print mode" is inserted and started.

The "print reservation mode" is a mode in which, after the preceding print operation is completed, a next print operation is performed based on a print command stored in advance during the preceding print operation. When the user operates the operation display panel 49 to input the conditions related to a desired print operation together with the execution date and time and to select the "print reservation mode", the subsequent print operation related to the "print reservation mode" is started after the preceding print operation is finished.

As described above, in the present embodiment, when binding by the first binder 91 (or the second binder 92) is interrupted and binding by the second binder 92 (or the first binder 91) is performed by executing the "interrupted print mode" or the "print reservation mode", binding by the second binder 92 (or the first binder 91) is performed without returning the first binder 91 (or the second binder 92) to the corresponding first reference position (or the second reference position) and without bringing the first binder 91 and the second binder 92 into contact with each other. Therefore, when the binding operation is switched, a distance J (see FIG. 7B) between the first binder 91 and the second binder 92 is obtained as described below.

Figure 7A:
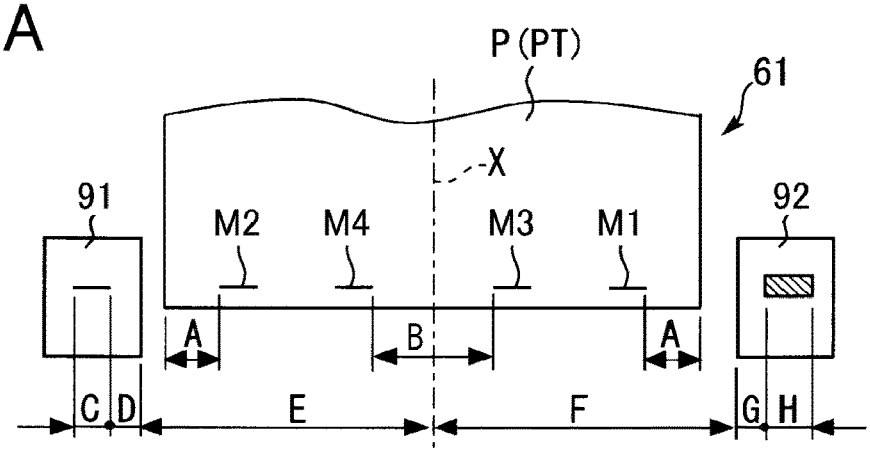
FIGS. 7A and 7B are diagrams illustrating relative sizes of a binding device in a width direction of the binding device according to an embodiment of the present disclosure.

FIG. 7A illustrates a case in which the first binder 91 (or the second binder 92) performs binding on four binding positions M1, M2, M3, and M4.

With reference to FIG. 7A, a distance E between the first binder 91 located at the corresponding first reference position and a center position X of the loading portion 61 (a center position in the width direction of the sheet P and the position between the two jogger fences 68) is set equal to a distance F between the second binder 92 located at the corresponding second reference position and the center position X (E=F). A distance between the first binding position M1 and the right end sides of the sheets P (sheet bundle PT) is set as distance A. A distance between the second binding position M2 and the left end sides of the sheets P (sheet bundle PT) is also set as distance A. A distance between the third binding position M3 and the fourth binding position M4 is set as distance B. The third binding position M3 and the fourth binding position M4 are positioned at an equal distance from the center position X. A binding width of a binding portion (staple) in the first binder 91 is set as distance C and the distance from the right end of the binding portion to the right end of the first binder 91 is set as distance D. A binding width of the binding portion (concave-convex portion) in the second binder 92 is set as width H, and the distance from the left end of the binding portion to the left end of the second binder 92 is set as width G.

Figure 7B:
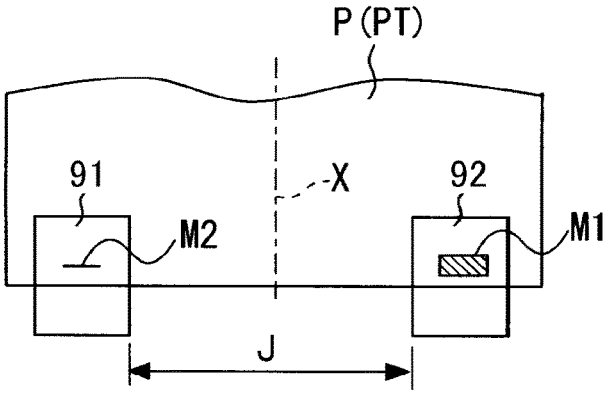

In the above-described setting, as illustrated in FIG. 7B, when the binding operation is switched, the first binder 91 is located at the second binding position M2 and the second binder 92 is located at the first binding position M1. At this time, the distance J between the first binder 91 and the second binder 92 satisfy the equation of distance J=(width size of sheet P÷2−A−C−D)+(width size of sheet P÷2−A−G−H). As described above, the distance J between the first binder 91 and the second binder 92 can be obtained by the controller 500 grasping the binding positions of the first binder 91 and the second binder 92 when the binding operation is switched in the control mode. Then, based on the distance J, whether the first binder 91 and the second binder 92 contact each other when the binding operation is switched can be grasped.

When the distance J is 0 or a negative value, it is possible to determine that the first binder 91 and the second binder 92 contact each other at the time of switching the binding operation. However, preferably, the above determination may be performed in consideration of a margin and variations due to accuracy of components or assembly accuracy of related components.

More specifically, a case in which the "control mode" according to the present embodiment is executed is described with reference to FIGS. 8A and 8B. The "control mode" may be executed before a sheet bundle PT1 as a target to be bound by one of the binders (e.g., the first binder 91) is placed on the loading portion 61 and after the one binder starts moving from the corresponding reference position. In such a case, if the one binder and the other binder (e.g., the second binder 92) do not contact each other even when the "control mode" is executed as it is, the mover is controlled not to move the one binder from the position at which the one binder and the other binder do not contact each other.

A specific example of such control, with reference to FIG. 8A, in which the print mode using the first binder 91 is set as the preceding print mode is described below. During the preceding print mode, feeding of the sheet P from the sheet feeding units 12, 13, and 14 (see FIG. 1) is not started, and the first binder 91 starts moving from the first reference position (the position indicated by the broken line with the reference numeral 91') and reaches a position indicated by the solid line in FIG. 8A (the position corresponding to the second binding position M2 in FIG. 7A). At this time, a print command of "interrupted print mode (control mode)" is issued to control the second binder 92 to perform binding at the binding position indicated by the reference numeral 92" in FIG. 8A. At this time, the distance J between the first binder 91 and the second binder 92 when the binding operation is switched, is obtained, and the first binder 91 and the second binder 92 does not contact each other.

Figure 8A:
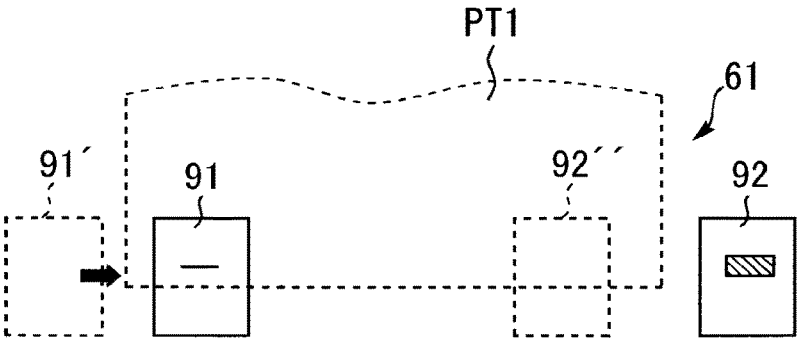
FIGS. 8A and 8B are diagrams illustrating an operation example of two binders in a control mode according to an embodiment of the present disclosure.
Figure 8B:
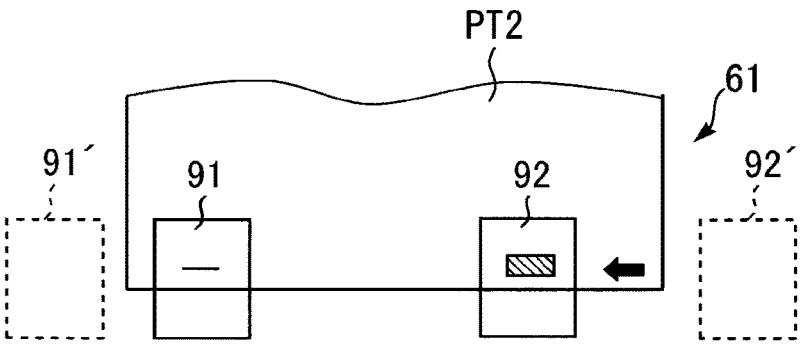

Accordingly, as illustrated in FIG. 8B, the second binder 92 is moved from the second reference position to the binding position while the first binder 91 is not moved from the position in FIG. 8A. After a sheet bundle PT2 subject to the interrupted print mode is placed on the loading portion 61, the second binder 92 performs binding.

After binding by the second binder 92 is completed and the second binder 92 is returned to the second reference position, the interrupted preceding print mode (the binding for the sheet bundle PT1) is resumed.

As described above, when the binding operation is switched, the subsequent binding is performed without returning the first binder 91 which performs the preceding binding to the first reference position. Further, when the interrupted preceding binding is resumed, the binding is performed as it is by the first binder 91 located at the binding position. Accordingly, the time required to complete the subsequent binding is shortened without causing a disadvantage that the first binder 91 and the second binder 92 contact each other and are damaged, and the time required to complete the two binding operations is also shortened. Thus, the productivity of the entire apparatus can be increased.

Note that, in the above example, one binding position is designated in the binding process related to the interrupted print mode. However, in a case in which two or more binding positions are designated in the binding process related to the interrupted print mode, the binder does not contact the other binder related to the preceding binding process even when the binder moves to all the binding positions. The above-described mechanism also applies to specific examples described later with reference to FIGS. 9A, 9B, 10A, and 10B.

Further, in the above example, the interrupted print mode is executed when feeding of the sheets P from the sheet feeding units 12, 13, and 14 is not started. However, even when feeding of the sheets P from the sheet feeding units 12, 13, and 14 is started, if the sheets P are temporarily stored in a purge unit and the sheet bundle PT related to the preceding binding process is not placed on the loading portion 61, the interrupted print mode can be similarly executed. The above-described mechanism also applies to specific examples described later with reference to FIGS. 9A, 9B, 10A, and 10B.

Further, another case in which the "control mode" according to the present embodiment is executed, is described with reference to FIGS. 9A and 9B. The "control mode" may be executed before a sheet bundle PT1 as a target to be bound by one of the binders (e.g., the first binder 91) is placed on the loading portion 61 and after the one binder starts moving from the reference position. In such a case, if the one binder and the other binder (e.g., the second binder 92) contact each other if the "control mode" is executed as it is, either the first mover (the first drive motor 113, the timing belt 114, and the first guide shaft 115) or the second mover (the second drive motor 123, the timing belt 124, and the second guide shaft 125) corresponding to the operation is controlled to move the one binder from the position at which the one binder and the other binder do not contact each other.

As a specific example of such control, with reference to FIG. 9A, in which a print mode using the first binder 91 is set as the preceding print mode is described below. During the preceding print mode, feeding of the sheet P from the sheet feeding units 12, 13, and 14 (see FIG. 1) is not started, and the first binder 91 starts moving from the first reference position (the position indicated by the broken line with the reference numeral 91') and reaches a position indicated by the solid line in FIG. 9A (the position corresponding to the fourth binding position M4 in FIG. 7A). At this time, a print command of "interrupted print mode (control mode)" is issued to control the second binder 92 to perform binding at the binding position indicated by the reference numeral 92" in FIG. 9A. At this time, the distance J between the first binder 91 and the second binder 92 in switching the binding operation is obtained, and the first binder 91 and the second binder 92 contact each other.

Figure 9A:
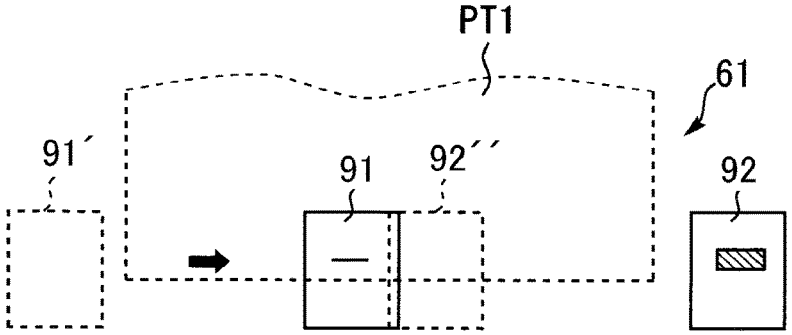
FIGS. 9A and 9B are diagrams illustrating another operation example of two binders in a control mode according to an embodiment of the present disclosure.
Figure 9B:
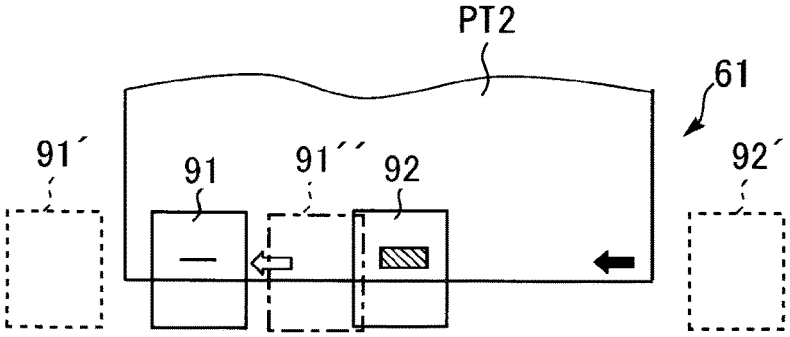

Accordingly, as illustrated in FIG. 9B, the first binder 91 is moved from the first reference position indicated by the broken line with the reference numeral 91" to the retraction position indicated by the solid line while the first binder 91 is not moved from the retraction position and the second binder 92 is moved from the second reference position to the binding position. After a sheet bundle PT2 subject to the interrupted print mode is placed on the loading portion 61, the second binder 92 performs binding.

After binding by the second binder 92 is completed and the second binder 92 is returned to the second reference position, the first binder 91 is moved from the retraction position to the position FIG. 9A. Thus, the interrupted preceding print mode (the binding for the sheet bundle PT1) is resumed.

As described above, when the binding operation is switched, the first binder 91 that is to perform the preceding binding operation, is not returned to the first reference position and moved to the retraction position located before the first reference position to perform the preceding binding operation. Further, when the interrupted preceding binding is resumed, the first binder 91 is moved from the retraction position to the binding position to perform binding. Accordingly, the time required to complete the subsequent binding is shortened without causing a disadvantage that the first binder 91 and the second binder 92 contact each other and are damaged, and the time required to complete the two binding operations is also shortened. Thus, the productivity of the entire apparatus can be increased.

More specifically, a case in which the "control mode" according to the present embodiment is executed is described with reference to FIGS. 10A and 10B. The "control mode" may be executed before the sheet bundle PT1 as a target to be bound by one of the binders (e.g., the first binder 91) is placed on the loading portion 61 and after the one binder starts moving from the reference position. In such a case, if the "control mode" is executed as is, the one binder and the other binder (e.g., the second binder 92) may contact each other. If the sheet bundle PT1 is bound at a desired position by the other binder in a state in which the sheet bundle PT1 as a target to be bound by the other binder is turned over and placed on the loading portion 61, the one binder and the other binder do not contact each other. At this time, the one binder is not moved from the position at which the one binder and the other binder do not contact each other. The control mode is executed in a state in which the sheet bundle PT1 as a target to be bound by the other binder is turned over and placed on the loading portion 61.

A specific example of such control, in which a print mode using the first binder 91 is set as a preceding print mode is described with reference to FIG. 10A. During the preceding print mode, feeding of the sheet P from the sheet feeding units 12, 13, and 14 (see FIG. 1) is not started, and the first binder 91 starts moving from the first reference position (the position indicated by the broken line with the reference numeral 91') and reaches a position indicated by the solid line in FIG. 10A (the position corresponding to the second binding position M2 in FIG. 7A). At this time, a print command of "interrupted print mode (control mode)" is issued to control the second binder 92 to perform binding at the binding position indicated by the reference numeral 92" in FIG. 10A. At this time, the distance J between the first binder 91 and the second binder 92 in switching the binding operation is obtained, and the first binder 91 and the second binder 92 contact each other.

Figure 10A:
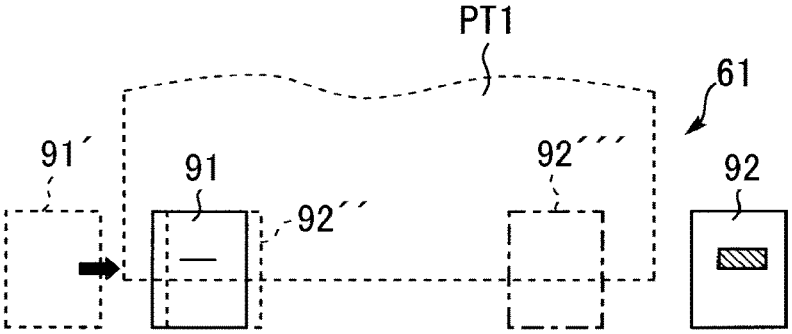
FIGS. 10A and 10B are diagrams illustrating still another operation example of two binders in a control mode according to an embodiment of the present disclosure.

At this time, the sheet bundle PT2 as a target to be bound by the second binder 92 is in a turned-over state (turned-over state) and the distance J between the first binder 91 and the second binder 92 when the binding position is displaced from the position 92" to the position 92'" in FIG. 10A is obtained and the first binder 91 and the second binder 92 does not contact each other.

Figure 10B:
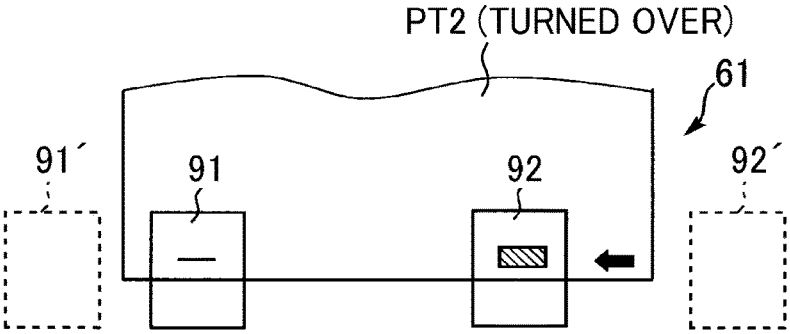

Accordingly, as illustrated in FIG. 10B, the second binder 92 is moved from the second reference position to the binding position while the first binder 91 is not moved from the position in FIG. 8A. After a sheet bundle PT2 subject to the interrupted print mode is turned over and placed on the loading portion 61, the second binder 92 performs binding.

After binding by the second binder 92 is completed and the second binder 92 is returned to the second reference position, the interrupted preceding print mode (the binding for the sheet bundle PT1) is resumed.

As described above, when the binding operation is switched, the subsequent binding is performed without returning the first binder 91 which performs the preceding binding to the first reference position. Further, when the interrupted preceding binding is resumed, the binding is performed as it is by the first binder 91 located at the binding position. Accordingly, the time required to complete the subsequent binding is shortened without causing a disadvantage that the first binder 91 and the second binder 92 contact each other and are damaged, and the time required to complete the two binding operations is also shortened. Thus, the productivity of the entire apparatus can be increased.

In the present embodiment, in a case in which the first binder 91 and the second binder 92 contact each other even if the sheet bundle PT2 related to the control mode (interrupted print mode) is turned over when the control described with reference to FIGS. 10A and 10B is performed, the control described with reference to FIGS. 9A and 9B is performed without reversing the sheet bundle PT2.

In other words, the "control mode" is executed before a sheet bundle PT1 as a target to be bound by one of the binders (e.g., the first binder 91) is placed on the loading portion 61 and after the one binder starts moving from the reference position. In such a case, if the "control mode" is executed as it is, the one binder and the other binder (e.g., the second binder 92) contact each other either. In particular, the one binder and the other binder may contact each other even if binding is performed by the other binder at a desired position in a state in which the sheet bundle PT2 as a target to be bound by the other binder is turned over and placed on the loading portion 61. In such a case, either the first mover (the first drive motor 113, the timing belt 114, and the first guide shaft 115) or the second mover (the second drive motor 123, the timing belt 124, and the second guide shaft 125) corresponding to the moving operation is controlled to move the one binder to the retracted position at which the one binder and the other binder do not contact each other.

Such a configuration as described above can increase the overall productivity of the apparatus.

In the present embodiment, when the control described with reference to FIGS. 10A and 10B is to be executed, the "other binder" used in the subsequent binding process in the control mode (interrupted print mode) is preferably the second binder 92 that performs binding without staples as illustrated in FIGS. 10A and 10B.

This is because in the case in which binding is performed by the second binder 92, even if the sheet bundle PT as a target to be bound is turned upside down, the appearance of the sheet bundle PT after the binding operation hardly changes.

On the contrary, when a user tries to execute the control described with reference to FIGS. 10A and 10B, the first binder 91 that performs binding with staples may be used as the "other binder" used in the subsequent binding operation in the control mode (interrupted print mode). In such a case, when the sheet bundle PT as a target to be bound is turned upside down, a state in which a direction in which the staples are bound is turned over can be apparently recognized. Accordingly, the appearance of the sheet bundle PT after the binding operation changes.

Therefore, when the sheet bundle PT as a target to be bound by the first binder 91 (the other binder) is placed upside down on the loading portion 61 and the "control mode" can be executed, preferably whether the "control mode" is feasible can be selected.

Specifically, in such a case, the operation display panel 49 displays that the appearance of the sheet bundle PT2 after binding deteriorates by performing the interrupted print mode (or the print reservation mode) as the control mode, and displays for the user to select whether to perform the binding operation resulting in the deteriorated appearance as is.

Performing such a control as describe above can expand the range of options for the user.

In the present embodiment, in the control as described with reference to FIGS. 10A and 10B, when the front and back sides of the sheet bundle PT2 are turned over, the print order (page order) in the image forming apparatus 1 is turned over from the print order in a normal state in which the front and back sides of the sheet bundle PT2 are not turned over.

Specifically, in the normal state, printing in the image forming apparatus 1 is performed in order from the last page, and the sheets are stacked in order from the last page in the loading portion 61 with the print surface (image surface) facing upward.

On the other hand, when the front and back sides of the sheet bundle PT2 are turned over, printing in the image forming apparatus 1 is sequentially performed from the first page and the front and back sides of the sheet bundle PT2 are turned over in the double-sided conveyance device 30 (see FIG. 1). Thus, the sheets are sequentially stacked on the loading portion 61 from the first page with the print surface (image surface) facing downward.

Finally, an example of control of switching between two binding operations is described with reference to flowcharts of FIGS. 11 and 12.

Figure 11:
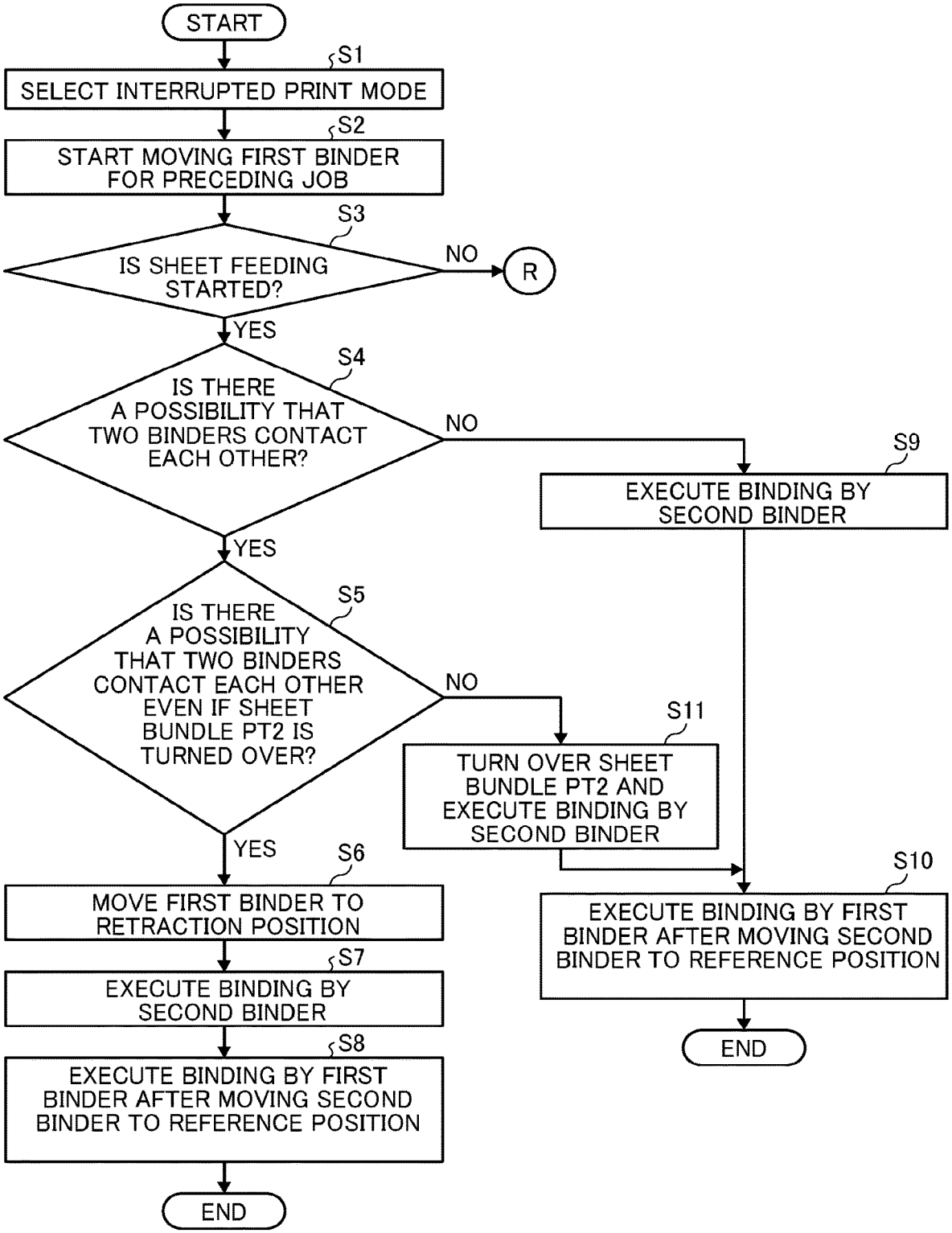
FIG. 11 is a flowchart of an example of control of two binders in a control mode according to an embodiment of the present disclosure.
Figure 12:
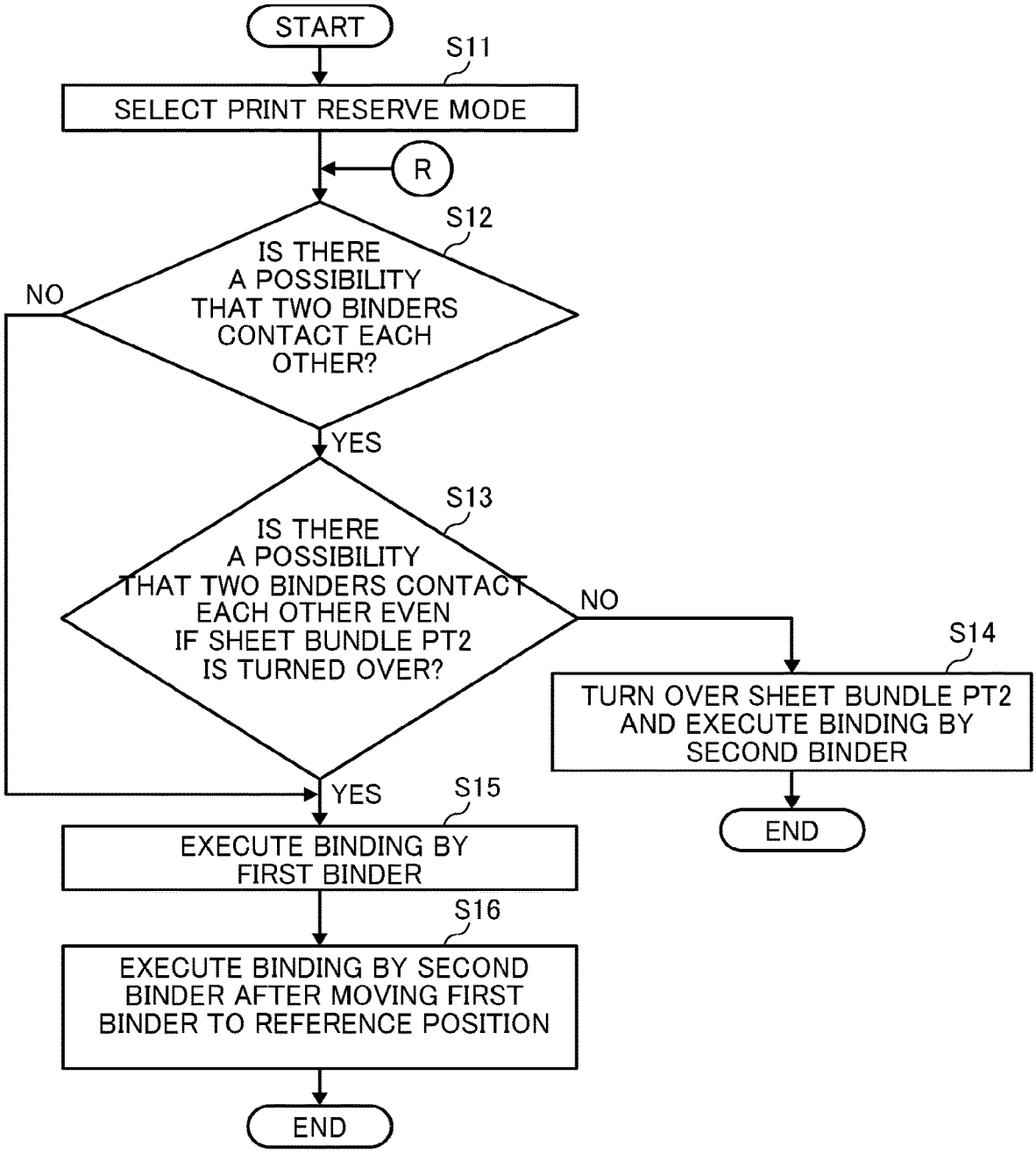
FIG. 12 is a flowchart of an example of control of two binders in a control mode, subsequent to the example of control in FIG. 11 according to an embodiment of the present disclosure.

First, as illustrated in FIG. 11, when the interrupted print mode is instructed by an operation on the operation display panel 49 (step S1), one of the binders related to a preceding job (binding in the preceding print mode) starts moving from the reference position, and the controller 500 determines whether sheet feeding (sheet conveyance) of the sheet P from the sheet feeding units 12, 13, and 14 is started (step S2 and S3).

As a result, when the controller 500 determines that the movement of the binder is started and the sheet P is not yet fed, the controller 500 determines whether there is a possibility that the first binder 91 and the second binder 92 contact each other when the binding operation (step S4). As a result, when the controller 500 determines that there is a possibility that the first binder 91 and the second binder 92 contact each other, the controller 500 determines whether there is a possibility that the first binder 91 and the second binder 92 contact each other even when the sheet bundle PT2 related to the subsequent binding (interrupted print mode) is turned over (step S5) As a result, when the controller 500 determines that there is a possibility that the first binder 91 and the second binder 92 contact each other even when the sheet bundle PT2 is turned over, one binder related to the preceding binding is moved to the retraction position (position before the reference position), and binding by the other binder related to the succeeding binding (interrupted print mode) is executed (steps S6 and S7).

Then, after the binding operation of the subsequent binding (interrupted print mode) is completed, the other binder is returned to the reference position and the one binder is moved from the retraction position to the desired binding position to execute the interrupted preceding binding (step S8). Then, after the binding operation related to the preceding binding is completed, one of the binders is returned to the reference position, and this operation flow ends.

On the other hand, in step S4, when the controller 500 determines that there is no possibility that the first binder 91 and the second binder 92 contact each other, one binder related to the preceding binding is not moved, and a binding operation by the other binder related to the subsequent binding (interrupted print mode) is executed (step S9).

Then, after the binding operation of the subsequent binding (interrupted print mode) is completed, the other binder is returned to the reference position, and the preceding binding operation interrupted by the one binder is executed (step S10). Then, after the binding operation related to the preceding binding is completed, one of the binders is returned to the reference position, and this operation flow ends.

On the other hand, in step S5, if the controller 500 determines that there is no possibility that the first binder 91 and the second binder 92 contact each other if the front and back sides of the sheet bundle PT2 is turned over, one of the binders related to the preceding binding operation is not moved, the front and back sides of the sheet bundle PT is turned over, and the other binder related to the succeeding binding operation (interrupted print mode) executes the binding (step S11).

Then, after the binding operation of the subsequent binding (interrupted print mode) is completed, the other binder is returned to the reference position, and the preceding binding operation interrupted by the one binder is executed (step S10). Then, after the binding operation related to the preceding binding is completed, one of the binders is returned to the reference position, and this operation flow ends.

On the other hand, in step 3, when the controller 500 does not determine that the movement of the binder is started and the sheet P is not yet fed, the controller 500 determines whether there is a possibility that the first binder 91 and the second binder 92 contact each other when the binding operation is switched (step S13).

Further, when the print reservation mode is selected on the operation display panel 49 (step S12), the controller 500 determines whether there is a possibility that the first binder 91 and the second binder 92 contact each other when the binding operation is switched (step S13).

As a result, when the controller 500 determines that there is a possibility that the first binder 91 and the second binder 92 contact each other in step S12, the controller 500 determines whether there is a possibility that the first binder 91 and the second binder 92 contact each other even when the front and back sides of the sheet bundle PT2 related to the subsequent binding (interrupted print mode) is turned over (step S14). As a result, when the controller 500 determines that there is a possibility that the first binder 91 and the second binder 92 contact each other even when the front and back sides of the sheet bundle PT2 is turned over, a binding operation by the one binder related to the preceding binding is executed (step S16).

Then, after the binding operation related to the preceding binding is completed, the one binder is returned to the reference position, and binding by the other binder related to the subsequent binding (interrupted print mode or print reservation mode) is executed (step S17). Then, after the binding operation related to the subsequent binding is completed, the other binder is returned to the reference position, and this operation flow ends.

On the other hand, when the controller 500 determines that there is no possibility that the first binder 91 and the second binder 92 contact each other in step S13, binding by the one binder related to the preceding binding is executed (step S16).

Then, after the binding operation related to the preceding binding is completed, the one binder is returned to the reference position, and binding by the other binder related to the subsequent binding (interrupted print mode or print reservation mode) is executed (step S17). Then, after the binding operation related to the subsequent binding is completed, the other binder is returned to the reference position, and this operation flow ends.

On the other hand, in step S14, if the controller 500 determines that there is no possibility that the first binder 91 and the second binder 92 contact each other when the front and back of the sheet bundle PT2 is turned over, one of the binders related to the preceding binding is not moved, the front and back sides of the sheet bundle PT is turned over, and the other binder related to the succeeding binding (interrupted print mode or print reservation mode) performs binding (step S15). Then, after the binding operation related to the binding is completed, the other binder is returned to the reference position, and this operation flow is ended.

As described above, the post-processing apparatus 50 according to the above-described embodiments of the present disclosure includes the loading portion 61 on which the plurality of sheets P is placed as the sheet bundle PT, the first binder 91 that performs binding on the sheet bundle PT that is moved from the first reference position to the desired binding position by the first mover (the first drive motor 113, the timing belt 114, and the first guide shaft 115) and placed on the loading portion 61, and the second binder 92 that performs binding on the sheet bundle PT that is moved from the second reference position to the desired binding position by the second mover (the second drive motor 123, the timing belt 124, and the second guide shaft 125) and placed on the loading portion 61. The "control mode" is executed before the sheet bundle PT as a target to be bound by one of the binders (the first binder 91 or the second binder 92) is placed on the loading portion 61 and after the movement of the one binder that performs binding either from a reference position corresponding to the one binder out of the first reference position and the second reference position is started. In such a case, the control mode is executed in a state in which the one binder and the other binder does not contact each other without returning the one binder to the corresponding reference position.

Such a configuration as described above can enhance the productivity of the post-processing apparatus 50.

Note that in the embodiments described above, the present disclosure is applied to the binding device 90 (first binding device). However, the present disclosure may also be applied to the binding device 83 (second binding device).

Further, in the embodiments described above, the present disclosure is applied to the post-processing apparatus 50 connected to the monochrome image forming apparatus 1. However, the present disclosure can also be applied to a post-processing apparatus connected to a color image forming apparatus.

Further, in the embodiments described above, the present disclosure is applied to the post-processing apparatus 50 connected to the monochrome image forming apparatus 1 that employs electrophotography. However, the present disclosure is not limited to the post-processing apparatus 50 connected to the monochrome image forming apparatus 1. The present disclosure can also be applied to a post-processing apparatus connected to an image forming apparatus of another type (for example, an ink jet image forming apparatus or a stencil printing machine).

Further, the present disclosure can be applied not only to the post-processing apparatus 50 connected to the image forming apparatus 1 but also to a post-processing apparatus as a single apparatus (for example, a post-processing apparatus including a sheet feeding tray disposed in an entry port and an operation display panel for inputting a processing mode or the like).

Any of the cases described above exhibit effects similar to those of the above-described embodiments of the present disclosure.

In the present embodiment, another post-processing device may be disposed between the image forming apparatus 1 and the post-processing apparatus 50 to perform, e.g., a Z-folding operation on the sheet P.

Further, in the embodiments described above, the present disclosure is applied to the post-processing apparatus 50 capable of performing binding, sorting, and folding operations. However, the present disclosure is not limited to the post-processing apparatus 50 capable of performing binding, sorting, and folding operations. However, the present disclosure can also be applied to a post-processing apparatus capable of performing hole punching operation, a post-processing apparatus performing only binding among a plurality of above-described operations.

In the embodiments described above, the present disclosure is applied to the binding device 90 in which the width direction of the binding device 90 (the direction in which the first binder 91 and the second binder 92 move) is set to the direction orthogonal to the conveyance direction. However, the present disclosure can also be applied to a binding device in which the width direction of the binding device is set to the conveyance direction (the direction in which the first binder 91 and the second binder 92 move).

Further, in the embodiments of the present disclosure, the first binder 91 performs binding using staples (metal staples) and the second binder 92 performs binding without staples (metal staples). However, configurations other than the configuration described above may be employed for the first binder 91 and the second binder 92.

Even in such configurations as described above, effects similar to those described above are also attained.

Note that embodiments of the present disclosure are not limited to the above-described embodiments and it is apparent that the above-described embodiments can be appropriately modified within the scope of the technical idea of the present disclosure in addition to what is suggested in the above-described embodiments. Further, the number, position, shape, and so forth of components are not limited to those of the present embodiment, and may be the number, position, shape, and so forth that are suitable for implementing the present disclosure.

Note that in this specification and the like, "sheet" is defined to include not only sheet of paper but also all sheet-shaped members as a target to be bound.

In the above descriptions, the term "printing" in the present disclosure may be used synonymously with, e.g. the terms of "image formation", "recording", "printing", and "image printing".

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A post-processing apparatus comprising:

a loading portion on which a plurality of sheets are placed as a sheet bundle;

a first binder configured to perform binding on the sheet bundle placed on the loading portion;

a first mover configured to move the first binder from a first reference position to a desired binding position at which the first binder performs binding on the sheet bundle placed on the loading portion;

a second binder configured to perform binding on the sheet bundle placed on the loading portion, a second mover configured to move the second binder from a second reference position to a desired binding position at which the second binder performs binding on the sheet bundle placed on the loading portion; and circuitry configured to execute a control mode in which, before the sheet bundle as a target to be bound by one binder of the first binder and the second binder is placed on the loading portion and after the one binder starts moving from a corresponding reference position of the first reference position and the second reference position, the circuitry causes the other binder of the first binder and the second binder to perform binding instead of the one binder, wherein the circuitry is configured to execute the control mode, without returning the one binder to the corresponding reference position, in a state in which the one binder and the other binder do not contact each other.

2. The post-processing apparatus according to claim 1, wherein the circuitry is configured to cause one of the first mover and the second mover not to move the one binder from a position at which the one binder and the other binder do not contact each other, if the one binder and the other binder do not contact each other even when the control mode is executed.

3. The post-processing apparatus according to claim 1, wherein the circuitry is configured to cause one of the first mover and the second mover to move the one binder from a retraction position at which the one binder does not contact the other binder, if the one binder and the other binder contact each other when the control mode is executed.

4. The post-processing apparatus according to claim 1, wherein in a case in which, even if the one binder and the other binder contact each other when the control mode is executed, the one binder and the other binder do not contact each other if the sheet bundle is bound at a desired position by the other binder in a state in which the sheet bundle as a target to be bound by the other binder is reversed and placed on the loading portion, the circuitry is configured to:

cause the one binder not to be moved from a position at which the one binder and the other binder do not contact each other; and execute the control mode in a state in which the sheet bundle as the target to be bound by the other binder is reversed and placed on the loading portion.

5. The post-processing apparatus according to claim 4, wherein the other binder is configured to perform binding without a staple.

6. The post-processing apparatus according to claim 4, wherein the other binder is configured to perform binding using a staple, and wherein the circuitry is configured to display a screen for selecting whether to execute the control mode, when the control mode is executable in a state in which the sheet bundle as the target to be bound by the other binder is reversed and placed on the loading portion.

7. The post-processing apparatus according to claim 1, wherein in a case in which, if the one binder and the other binder contact each other when the control mode is executed, the one binder and the other binder contact each other even if binding is performed at a desired position by the other binder in a state in which the sheet bundle as a target to be bound by the other binder is reversed and placed on the loading portion, the circuitry is configured to control one of the first mover and the second mover to move the one binder to a retraction position at which the one binder does not contact the other binder.

8. The post-processing apparatus according to claim 1, wherein the first binder is configured to perform binding using a staple, and wherein the second binder is configured to perform binding without a staple.

9. The post-processing apparatus according to claim 1, wherein the control mode is an interrupted print mode in which a preceding print operation is interrupted and another print operation is performed based on a new print command operated during the preceding print operation, or a print reservation mode in which a next print operation is performed after a preceding print operation is completed based on a print command stored in advance during the preceding print operation.

10. An image forming system comprising:

an image forming apparatus configured to form an image on a sheet; and the post-processing apparatus according to claim 1 configured to perform post-processing on the sheet on which the image has been formed by the image forming apparatus.

* * * * *